US011299828B2

(12) United States Patent
Ceria et al.

(10) Patent No.: US 11,299,828 B2
(45) Date of Patent: Apr. 12, 2022

(54) KNIT STRUCTURES WITH REDUCED CURL AND ROLL OVER AND A METHOD OF MAKING SAME

(71) Applicant: The LYCRA Company LLC, Wilmington, DE (US)

(72) Inventors: Alberto Ceria, Buccinasco (IT); Davide Rossi, Castel Goffredo (IT)

(73) Assignee: THE LYCRA COMPANY LLC, Wilmington, DE (US)

( * ) Notice: Subject to any disclaimer, the term of this patent is extended or adjusted under 35 U.S.C. 154(b) by 0 days.

(21) Appl. No.: 17/254,525

(22) PCT Filed: Jul. 2, 2019

(86) PCT No.: PCT/US2019/040390

§ 371 (c)(1),
(2) Date: Dec. 21, 2020

(87) PCT Pub. No.: WO2020/010135

PCT Pub. Date: Jan. 9, 2020

(65) Prior Publication Data

US 2021/0269950 A1 Sep. 2, 2021

Related U.S. Application Data

(60) Provisional application No. 62/693,056, filed on Jul. 2, 2018.

(51) Int. Cl.

| | |
|---|---|
| ***D04B 1/10*** | (2006.01) |
| ***D04B 1/18*** | (2006.01) |
| ***D04B 1/26*** | (2006.01) |

(52) U.S. Cl.
CPC ..... *D04B 1/106* (2013.01); *D04B 1/18* (2013.01); *D04B 1/26* (2013.01); *D10B 2501/021* (2013.01)

(58) Field of Classification Search
CPC . D04B 1/106; D04B 1/26; D04B 1/18; D10B 2331/102; D10B 2501/021
USPC ..... 66/172 R
See application file for complete search history.

(56) References Cited

U.S. PATENT DOCUMENTS 2,044,966 A * 6/1936 Baugh ..... D04B 1/26 66/172 R
2,139,606 A * 12/1938 Scholz ..... D04B 9/46 66/172 E
2,231,434 A * 2/1941 Cantner ..... D04B 9/54 66/172 E (Continued)

FOREIGN PATENT DOCUMENTS

GB 513615 10/1939

OTHER PUBLICATIONS

International Search Report and Written Opinion in PCT/US2019/040390 dated Nov. 11, 2019.

(Continued)

*Primary Examiner* — Danny Worrell
(74) *Attorney, Agent, or Firm* — Bridget C. Sciamanna; Kathleen A. Tyrrell

(57) ABSTRACT

Knit structures and processes for constructing knit structures which can be used as a replacement for double layer bands in articles of clothing such as, but not limited to, pantyhose, stockings, stay ups and socks are provided.

10 Claims, 3 Drawing Sheets

(56) References Cited

U.S. PATENT DOCUMENTS

| | | | | | |
|---|---|---|---|---|---|
| 2,256,691 | A * | 9/1941 | Smith, Jr. | D04B 9/54 | 66/172 R |
| 2,306,914 | A * | 12/1942 | Smith, Jr. | D04B 9/54 | 66/172 E |
| 2,311,166 | A * | 2/1943 | Fregeolle | D04B 9/54 | 66/172 E |
| 2,315,119 | A * | 3/1943 | Green | D04B 9/54 | 66/172 E |
| 2,324,036 | A * | 7/1943 | Smith, Jr. | D04B 9/54 | 66/172 E |
| 2,333,870 | A * | 11/1943 | Lawson | D04B 1/18 | 66/172 E |
| 2,414,424 | A * | 1/1947 | Stevens, Jr. | D04B 1/00 | 428/193 |
| 2,731,819 | A * | 1/1956 | Crawford | D04B 9/54 | 66/172 E |
| RE24,384 | E * | 10/1957 | Elder et al. | D04B 9/54 | 66/172 E |
| 2,881,603 | A * | 4/1959 | Vendetti | D04B 1/106 | 66/9 R |
| 3,078,697 | A * | 2/1963 | Johnson | D04B 1/26 | 66/9 R |
| 3,237,431 | A * | 3/1966 | Lawson | D04B 9/54 | 66/41 |
| 3,600,909 | A | 8/1971 | Kaplan | | |
| 3,908,407 | A | 9/1975 | Brand et al. | | |
| 4,499,742 | A * | 2/1985 | Burn | D04B 1/26 | 66/172 E |
| 4,548,057 | A * | 10/1985 | Essig | D04B 1/06 | 66/172 R |
| 2009/0044572 | A1* | 2/2009 | Fujita | D02G 3/32 | 66/177 |
| 2021/0269950 | A1* | 9/2021 | Ceria | D04B 1/18 | |

OTHER PUBLICATIONS

International Preliminary Report on Patentability in PCT/US2019/040390 dated Jan. 5, 2021.

* cited by examiner

KNIT STRUCTURES WITH REDUCED CURL AND ROLL OVER AND A METHOD OF MAKING SAME

FIELD OF THE INVENTION

This disclosure relates to knit structures and methods for producing knit structures with a combination of stitches which provide force towards the inside of the knit structure and reduce curl outwards and subsequent roll over. Knit structures of this disclosure can be used as a replacement for double layer bands in articles of clothing such as, but not limited to, pantyhose, stockings, stay ups and socks.

BACKGROUND OF THE INVENTION

A typical single jersey knit structure rolls over at its end due to the two faces of the fabric having unbalanced forces; this phenomenon increases when elastic yarns are used in the construction. Accordingly, single jersey knit structure ends are oftentimes folded by sewing or by creating a double layer of fabric during production.

Typically, hosiery and socks are produced in small single cylinders approximately 4 inches in diameter for hosiery and 3¾ inches for socks. At least one of the yarns used in the construction is usually elasticized. Examples include covered spandex or bare spandex. The first portion of the tube usually represents the upper band, welt or waist band. To prevent this portion from curling or rolling over during processing, wear and use, it is usually formed from a double layer of fabric. This double layer ranges in height from millimeters or several centimeters according to the chosen design and is generally machine-formed using dial jacks.

Typically, in socks, panty hose and stay ups which are also known as thigh highs, hold ups or stockings, produced on a single cylinder knitting machine where the knitted tube is not further sewn in its upper end, the knitted tube is likely to roll over if the double layer technique described above is not used. Ways to mitigate roll over without a double layer are to use a heavier count yarn combination to increase significantly the denier of the structure or to use a double cylinder machine or equivalent knit structures.

Specifically, stay ups which require application of silicon or high friction material on the knitted tube to help the garment keeping the position when worn, are generally produced with a band generated by means of dial jacks. Without using dial jacks to form a double band, the resulting single jersey knitted structure will likely roll over when worn.

There is a need for alternative knit structures and methods for producing knit structures which provide force towards the inside of a knitted tube and reduce outward curl and subsequent roll over.

SUMMARY OF THE INVENTION

The inventors herein have surprisingly found a stitch combination for production of the upper part of a knit structure which drastically reduces the rolling over of the fabric end thus allowing for the production of articles of clothing such as, but not limited to, pantyhose, stockings, stay ups and socks without using dial jacks and in general without creating a double layer. Or without the more tradition band with silicon that needs to be sewn on the knitted tube Accordingly, an aspect of the present invention relates to a method for producing a knit structure with reduced outward curling and/or rolling at its fabric end. This method involves a knitting procedure which uses cylinder needles instead of dial jacks, which provides the inward force need to reduce curl. The needles carry the yarn(s) and start a knit structure, referred to herein as the START part, which can extend multiple courses. The needles are then allocated into at least two sections. This usually occurs by means of a knitting program. The allocation is only general concept, in that some needles will make a certain type of stitch or stitch sequence and other needles may make another type of stitch or stitch sequence. The allocated sections include a knit needle section and a miss needle section, to produce a second section adjacent to the START part and referred to herein as the FALSE BAND. In each course of the FALSE BAND part, at least one needle of the knit needle section performs a knit stitch while at least one needle of the miss needle section performs a miss stitch. When the FALSE BAND part has reached the desired length, the needles of the miss needles sections start to knit and form what it referred to herein as the CLOSE part. Each needle in each course may perform a variety of stich types depending upon the knitting program that is employed. Because of the miss needle sections of the FALSE BAND part, the last course of the START part is interconnected with the first course of the CLOSE part resulting is a knit structure with higher tension and force toward the inside, opposing the rolling over phenomenon without compromising the cross-stretch extension.

In one nonlimiting embodiment, an additional yarn is included to further reduce tendency to curl and roll over at its edge. Typically, polyamide yarns having between 8 and 80 dtex are used in hosiery. The reason this yarn helps is because it increases the weight of the fabric of the CLOSE part with respect to the FALSE BAND part and help reducing roll over. However, the yarn composition is not limited to polyamide yarns, other types of yarns could be utilized depending upon the desired embodiment.

Another aspect of the present invention relates to knit structure comprising a combination of stitches which provide force towards the inside of the knit structure and reduce outward curl and subsequent roll over. In one embodiment the knit structure is produced on cylinder needles instead of dial jacks of the knitting machine. The knit structure comprises a START part extending one or more courses, a FALSE BAND part adjacent to the START part comprising multiple courses of knit stitch and miss stitch; and a CLOSE part of knit stitch extending one or more courses adjacent to the FALSE BAND. Because of the miss stitches of the FALSE BAND part, the last course or courses of the START part is interconnected with the first course or courses of the CLOSE part resulting is a knit structure with higher tension and force toward the inside, opposing the rolling over phenomenon without compromising the cross-stretch extension.

Another aspect of the present invention relates to article of manufacture at least a portion of which comprises the knit structure of this invention. In one nonlimiting embodiment, the article of manufacture is an article of clothing. In one nonlimiting embodiment, the article of clothing is selected from pantyhose, stockings, leggings, stay ups and socks.

DETAILED DESCRIPTION OF THE INVENTION

Figure 1:
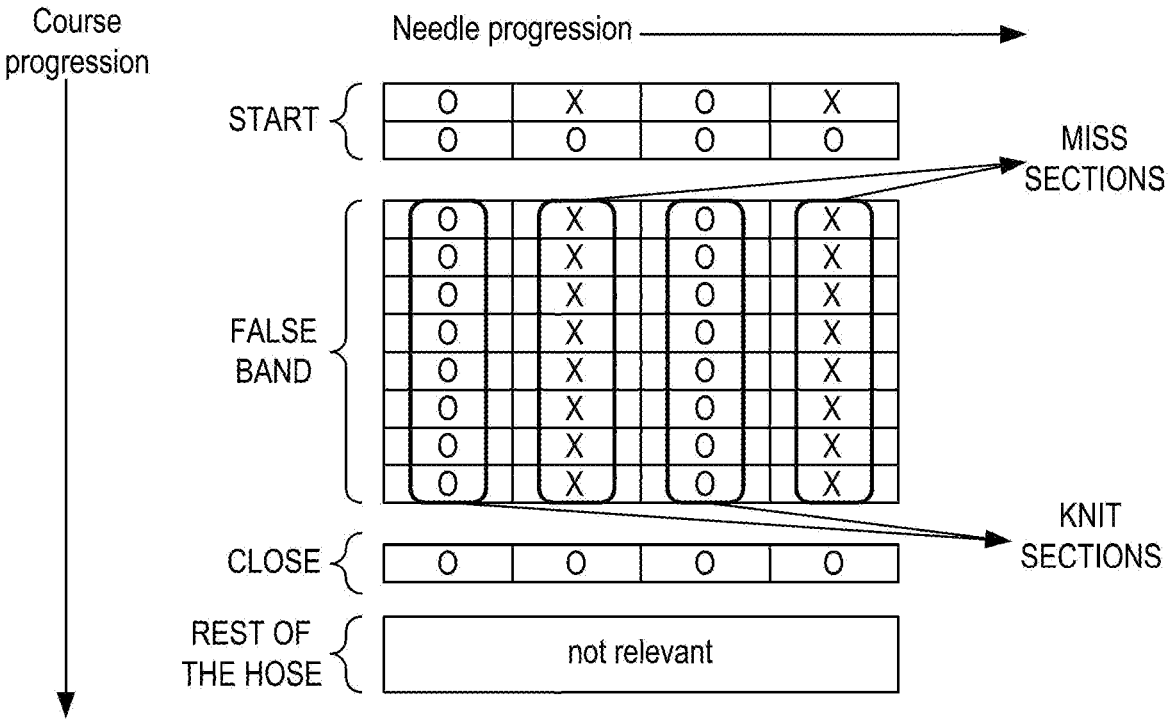
FIG. 1 is a nonlimiting example of a knit structure of this disclosure with stitch notation constructed using a 400 needle single cylinder hosiery knitting machine at 4 inch diameter and having 4 feeds. The rows represent the courses and the columns represent the needles. In this nonlimiting embodiment, "O" is a needle knitting a stitch; "X" is a needle missing a stitch; "." indicates the stitch is same as above; START part is 2 courses; FALSE BAND part is 8 courses; MISS sections are all equal and 1 needle long; and KNIT sections are all equal and 1 needle long. The START and FALSE BAND part are formed using 22 dtex spandex single covered with 17 dtex polyamide (PA). In the CLOSE part, a 33 by 2 dtex PA is plated in with the covered yarn. The rest of the hose part has the same structure as the CLOSE part.

This invention relates to knit structures and methods for producing knit structures with a combination of stitches which provide force towards the inside of the knitted structure thereby reducing outward curling and subsequent roll over at its edge. Knit structures of this disclosure can be used as a replacement for double layer bands in articles of clothing such as, but not limited to, pantyhose, stockings, stay ups and socks.

Methods for reducing rolling over of the fabric end of a knit structure in accordance with the present invention involve a knitting procedure which uses cylinder needles instead of dial jacks of the knitting machine. The needles carry the yarn(s) and start a knit structure, referred to herein as the START part, which can extend multiple courses. In one nonlimiting embodiment, the START part only extends 1 to 8 courses, however in some embodiments the START part may be greater than 8 courses. The needles are ideally divided into at least two sections, a knit needle section and a miss needle section, to produce a second section adjacent to the START part and referred to herein as the FALSE BAND part or section. In each course of the FALSE BAND part, at least one needle of the knit needle section performs a knit stitch while at least one needle of the miss needle section performs a miss stitch. In one embodiment, each course of the FALSE BAND part, at least one needle of the knit needle section performs a knit stitch while all of the miss needle section performs a miss stitch. In one nonlimiting embodiment, each knit and miss needle section is different from other knit and miss needle sections of the structure. For example, in one embodiment a knit needle section may be of only one needle which knits; or may be of two needles one knitting one missing, with the course below having one missing and one knitting needle.

A miss section may be comprised of one section having only one needle missing; alternatively, two needles missing; or as extreme example could have even more than 3 needles missing. In one nonlimiting embodiment, the knit needle section and the miss needle section follow each other and this sequence repeats for all the needles of the cylinder. In one nonlimiting embodiment, there are only knit and miss needle sections extending one needle each in, for example, a 400 needle machine, in a pattern of one needle knit following by one needle miss for all 400 needles. When the FALSE BAND part has reached the desired length, e.g. 8 courses in total; or between 2 and 20, the needles of the miss needles sections will start to knit and form what it referred to herein as the CLOSE part. There is no limit to what length will make up the CLOSE part, for instance in some embodiments, the remainder of the garment can be considered to make up the CLOSE part. What is important is that in the first courses (for example, courses 1 to 4 or some other early courses) the needles of the miss needle section make a knit. Because of the miss needle sections of the FALSE BAND part, the last course (or courses, depending on the structure) of the START part will be then interconnected with the first course (or courses, depending on the structure) of the CLOSE part. The result is a fabric structure with higher tension and force toward the inside of the tube, opposing the rolling over phenomenon without compromising the cross stretch extension.

In one nonlimiting embodiment, an additional yarn is included to further reduce tendency to curl and roll over.

Knit and miss needle sections can vary in length and number of needles. In one nonlimiting embodiment, the sections comprise one needle each. Knit and miss needle sections are preferably subsequent but can be followed or preceded by other sections with stitch of different nature, for example tuck stitches or combinations of different stitches.

Figure 2:
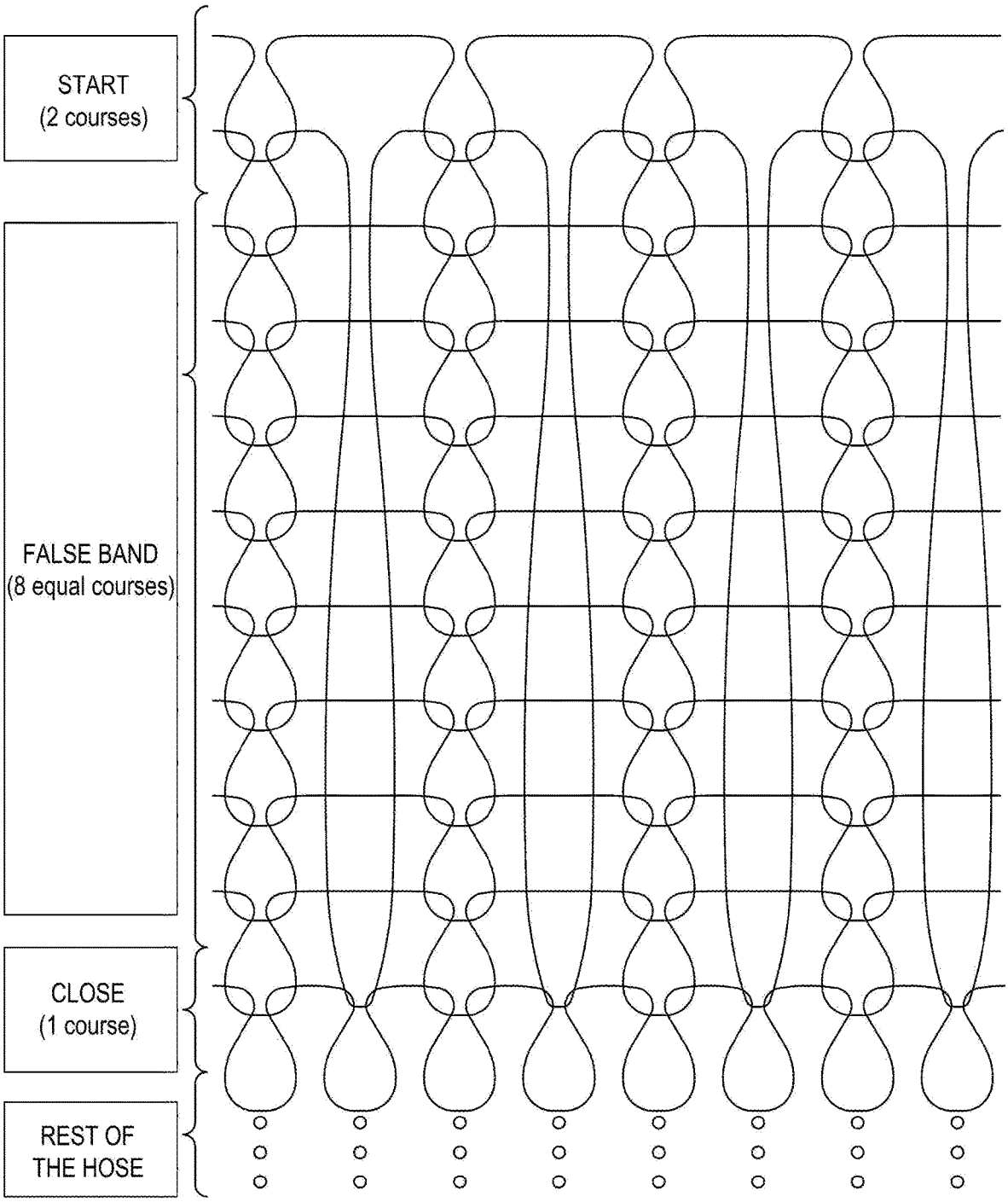
FIG. 2 provides a sketch of the knit structure constructed in FIG. 1.
Figure 3:
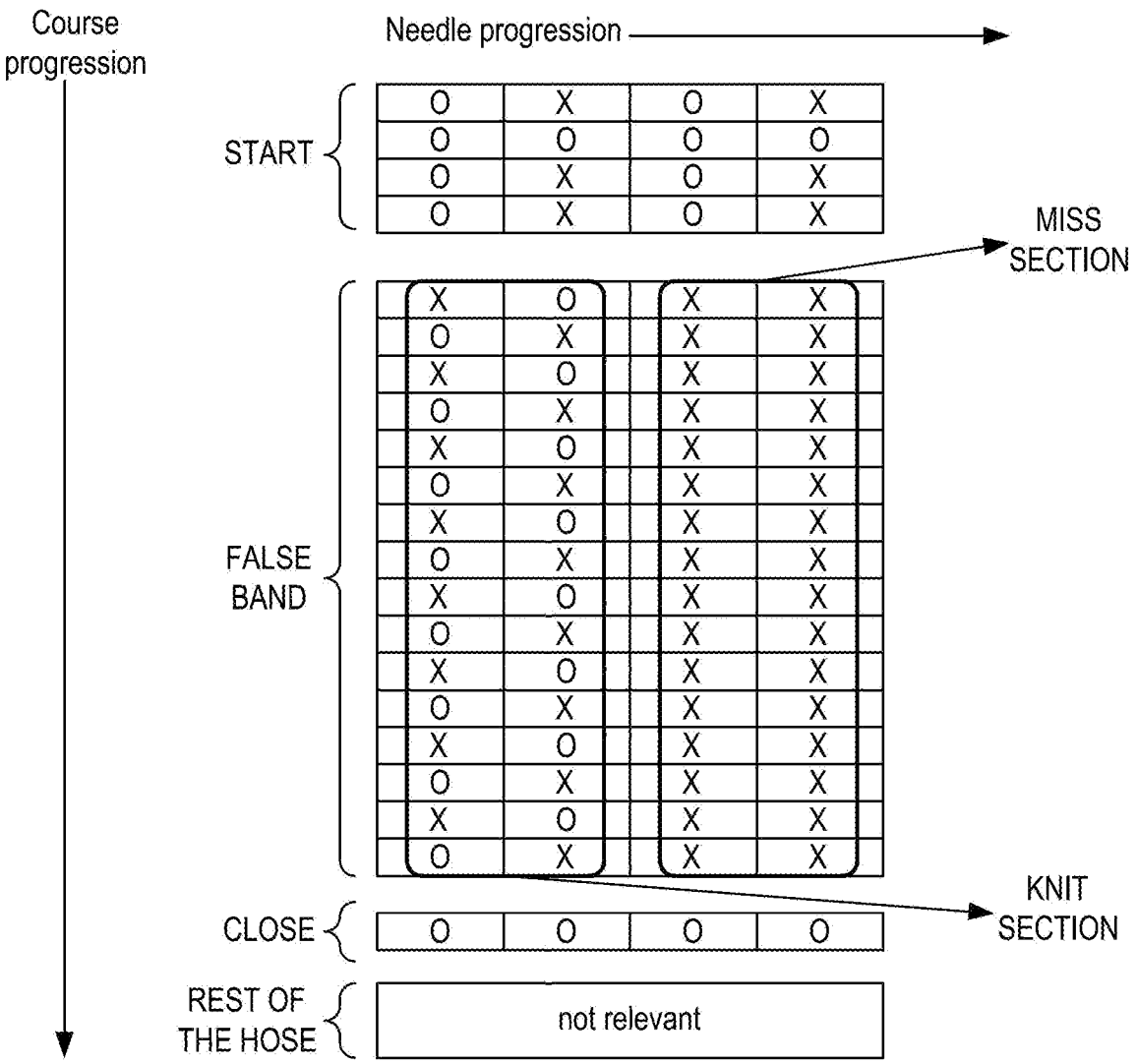
FIG. 3 provides another nonlimiting example of a knit structure of this disclosure wherein "O" represents a needle knitting a stitch; "X" represents a needle missing a stitch.

Knit structures in accordance with the present invention comprise a combination of stitches which provide force towards the inside of the knit structure and reduce curl outwards and subsequent roll over. In one embodiment, the knit structure is produced on cylinder needles instead of dial jacks. As shown in FIGS. 1 through 3, the knit structure comprises a START part extending one or more courses. Adjacent to the START part of the knit structure is a FALSE BAND part or section. The FALSE BAND section comprises multiple courses of knit stitch and miss stitch. In one nonlimiting embodiment, the FALSE BAND section comprises 8 courses. The knit structure further comprises a CLOSE part extending one or more courses adjacent to the FALSE BAND. Because of the miss stitches of the FALSE BAND part, the last course of the START part is interconnected with the first course of the CLOSE part resulting is a knit structure with higher tension and force toward the inside, opposing the rolling over phenomenon without compromising the cross-stretch extension.

Articles of manufacture in accordance with the present invention are comprised of at least a portion of the knit structures described herein. Nonlimiting examples of these articles include clothing such as, but not limited to, pantyhose, stockings, stay ups and socks. All standard garment processing steps are understood to be applicable to the fabric of the invention. (e.g. scour, dyeing, heat setting or boarding, application of softeners).

The invention claimed is:

1. A method for producing a knit structure with reduced curling outward and/or rolling at its fabric end without a double layer, said method comprising:

carrying yarn using cylinder needles and knitting a START part of the knit structure extending one or more courses;

dividing needles of the cylinder needles into at least two sections comprising a knit needle section and a miss needle section and producing a FALSE BAND section adjacent to the START part, said FALSE BAND comprising multiple courses of a knit stitch and a miss stitch; and starting needles of the miss needles sections to knit and form a CLOSE part adjacent to said FALSE BAND, wherein a course of the START part is interconnected with a course of the CLOSE part resulting is a knit structure with higher tension and force toward inside of the knit structure, opposing any rolling over phenomenon without compromising the cross-stretch extension and without a double layer.

2. The method of claim 1 wherein the knit needle section and the miss needle section follow each other and this sequence repeats for all the needles of the cylinder.

3. The method of claim 1 wherein only knit needle sections and miss needle sections extending one needle each in a pattern of one needle knit followed by one needle miss produce the FALSE BAND section.

4. The method of claim 1 wherein a 400 needle machine is used.

5. The method of claim 1 wherein the FALSE BAND comprises 4 to 20 courses in total.

6. The method of claim 1 wherein the knit structure contains polyamide yarns having between 8 and 80 dtex.

7. A knit structure comprising a combination of stitches which provide force towards the inside of the knit structure and reduce curl outwards and subsequent roll over without a double layer, said knit structure comprising:

a START part extending one or more courses;

a FALSE BAND part adjacent to the START part comprising multiple courses of knit stitch and miss stitch; and a CLOSE part extending one or more courses adjacent to the FALSE BAND, wherein a course of the START part is interconnected with a course of the CLOSE part resulting is a knit structure with higher tension and force toward inside of the knit structure, opposing any rolling over phenomenon without compromising the cross-stretch extension and without a double layer.

8. An article of manufacture at least a portion of which comprises the knit structure of claim 7.

9. The article of manufacture of claim 8 which is article of clothing.

10. The article of manufacture of claim 9 wherein the article of clothing is selected from pantyhose, stockings, stay ups and socks.

* * * * *